US005145387A

United States Patent [19]

Ichihashi

[11] Patent Number: 5,145,387

[45] Date of Patent: Sep. 8, 1992

[54] HIGH-FREQUENCY MULTI-PIN CONNECTOR

[75] Inventor: Toshihiro Ichihashi, Kumagaya, Japan

[73] Assignee: Advantest Corporation, Tokyo, Japan

[21] Appl. No.: 737,259

[22] Filed: Jul. 29, 1991

[30] Foreign Application Priority Data

Jul. 30, 1990 [JP] Japan ..... 2-80809[U]

[51] Int. Cl.[5] ..... H01R 13/652

[52] U.S. Cl. ..... 439/108; 333/260

[58] Field of Search ..... 439/108, 101, 92; 333/1, 238, 246, 260

[56] References Cited

U.S. PATENT DOCUMENTS 4,479,230 10/1984 Auzet et al. ..... 375/108
4,602,831 7/1986 Lockard ..... 439/108
4,878,233 10/1989 Hayashi ..... 375/116
4,908,871 3/1990 Hara et al. ..... 382/8
5,057,028 10/1991 Lemke et al. ..... 439/108

*Primary Examiner*—Gary F. Paumen
*Attorney, Agent, or Firm*—Staas & Halsey

[57] ABSTRACT

Three male pin contacts arranged in parallel in the same plane are mounted on a plug body of a connector plug so that the three male pin contacts form one signal transmission line. In a socket body of a connector socket for engagement with the connector plug there is provided a contact receiving chamber, in which three female contacts formed by plate springs are arranged in parallel in the same plane. The three female contacts form one signal transmission line. The center ones of the three male pin contacts and the three female contacts are used as signal lines and both side contacts are used as grounding lines, by which open microstrip line structures are formed. When the connector plug is fitted into the connector socket, each of the three female contacts are brought into contact, at one point, with the male pin contact corresponding thereto.

11 Claims, 5 Drawing Sheets

HIGH-FREQUENCY MULTI-PIN CONNECTOR

BACKGROUND OF THE INVENTION

The present invention relates to a high-frequency multi-pin connector which can be employed for electrically interconnecting printed circuit boards each having mounted thereon a high-frequency circuit, for instance.

FIG. 1 shows in perspective the external appearance of a conventional multi-pin connector. Reference numeral 10 indicates a connector socket and 20 a connector plug.

The connector socket 10 has a construction in which forked female contacts 13 are received in a number of female contact receiving holes 12 made in one side of a rectangular prismatic insulating body 11 as shown in FIG. 2. The connector plug 20 has a number of male pin contacts 22 protrusively planted on one side of a rectangular prismatic insulating body 21. The male pin contacts 22 are respectively inserted into the female contact receiving holes 12 for electrical contact with the female contacts 13. In this example, the connector socket 10 is shown to have connected thereto a flat cable 30 and the connector plug 20 is shown to be mounted on a printed circuit board 40.

To ensure high reliability of its contact, the conventional multi-pin connector employs the forked female contact 13 which makes contact with the male pin contact 22 at two points a and b or more as depicted in FIG. 2. With such a multi-pin contact structure, it is difficult to make the characteristic impedance of a signal path constant Further, since the connector plug 20 has a construction in which the male pin contacts 22 are disposed in parallel and signals are applied to such parallel male pin contacts 22, the signals interfere with each other, resulting in a crosstalk. Moreover, in the connector socket 10 the female contact 13 is forked and makes contact with the male pin contact 22 at the two points a and b, but when the former cannot contact with the latter at either one of the two points a and b by some cause, the non-contacting piece of the female contact 13 forms a parasitic inductance and a parasitic capacitance, which produce a resonance circuit or the like, adversely affecting the signal transmission characteristic.

SUMMARY OF THE INVENTION

It is therefore an object of the present invention to provide a high-frequency multi-pin connector which permits matching of the characteristic impedance to a predetermined one in either of the connector socket and the connector plug, produces no crosstalk and maintains the signal transfer characteristic unchanged irrespective of a change in the contact condition.

According to an aspect of the present invention one signal transmission line is formed by three contacts disposed in parallel in the same plane. A central one of the three contacts is used as a signal line and both side contacts are used as grounding lines. Such a structure in which a signal line is interposed between grounding lines constitutes a kind of open microstrip line structure. Accordingly, the characteristic impedance of the signal line can be matched to a desired impedance by suitable selections of the width of each contact and the center-to-center spacing of the contacts serving as grounding lines.

According to another aspect of the present invention, a plurality of triads of contacts are arranged in a line at regular intervals at least twice the pitch of the contacts to form a first array of contacts, and a similar second array of contacts is disposed opposite the first array. In this instance, those of the contacts of the second array which serve as signal lines are each disposed opposite the space by which adjacent triplets of contacts of the first array are separated.

With the above-mentioned structure of the present invention in which the central one of the three contacts is used as a signal line and both side contacts as grounding lines, the characteristic impedance of the signal transmission line formed by the three contacts can be matched to a desired impedance.

According to another aspect of the present invention, one female contact is made to contact with each male contact of the connector plug, parasitic inductance and parasitic capacitance formed by the contacts are small and, consequently, even if the contact condition changes, the change in the parasitic inductance and capacitance is small, thus maintaining the characteristic impedance constant.

Thus, the present invention permits matching of the characteristic impedance of each signal transmission line to a desired impedance and prevents appreciable change in a parasitic inductance and a parasitic capacitance, and hence provides a high-frequency connector which is free from reflection or other undesirable phenomenon.

DESCRIPTION OF THE PREFERRED EMBODIMENTS

Figure 1:
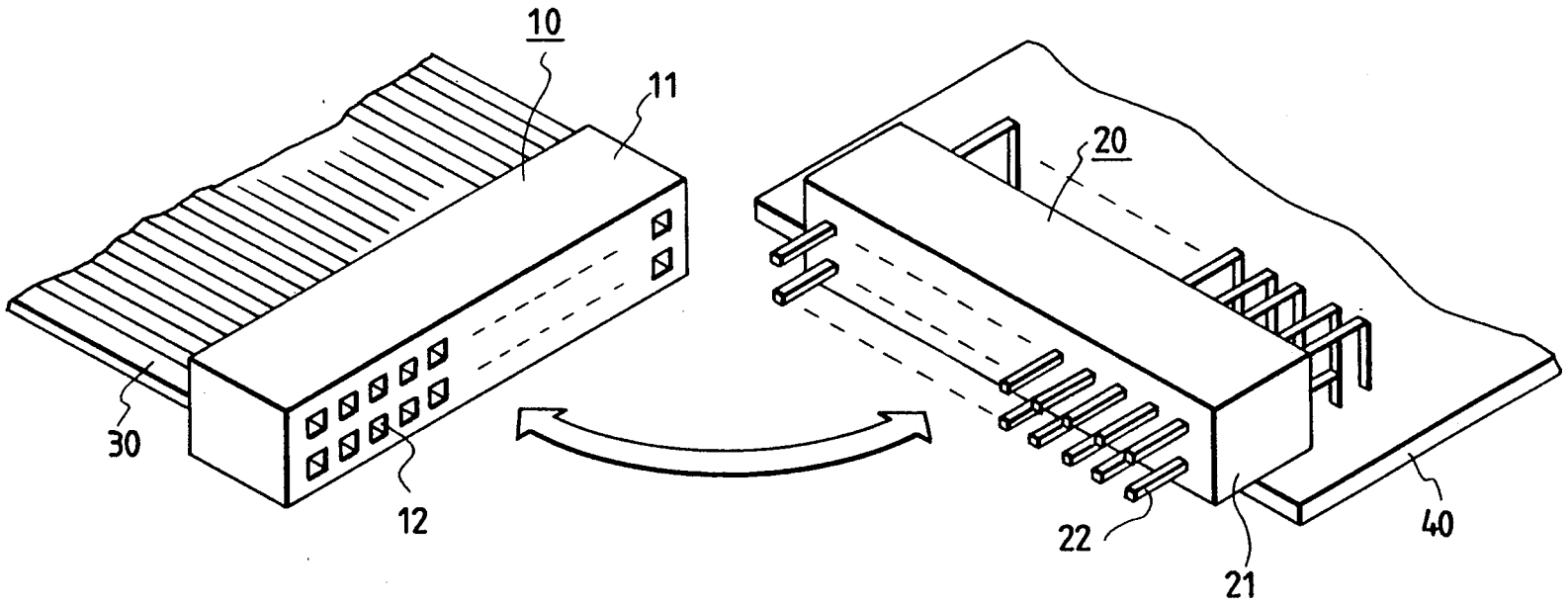
FIG. 1 PRIOR ART
FIG. 1 is an exploded perspective view showing a prior art example.
Figure 2:
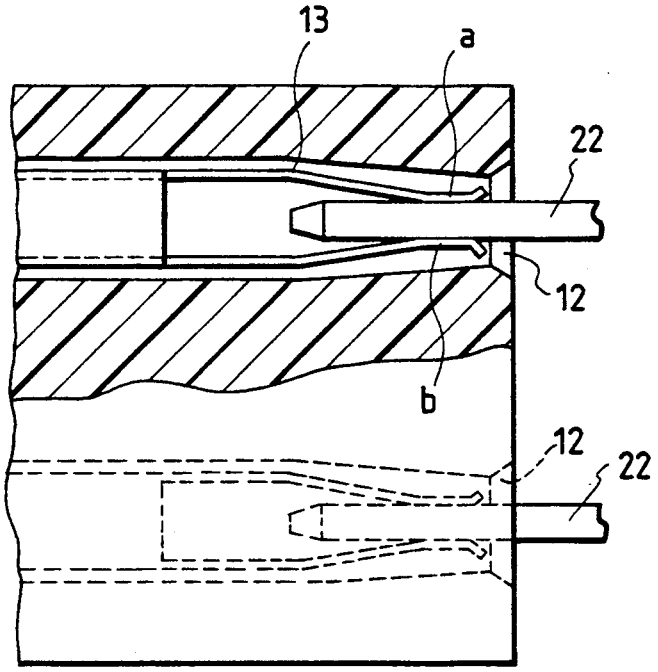
FIG. 2 PRIOR ART
FIG. 2 is a sectional view showing the internal construction of a connector socket depicted in FIG. 1.
Figure 3:
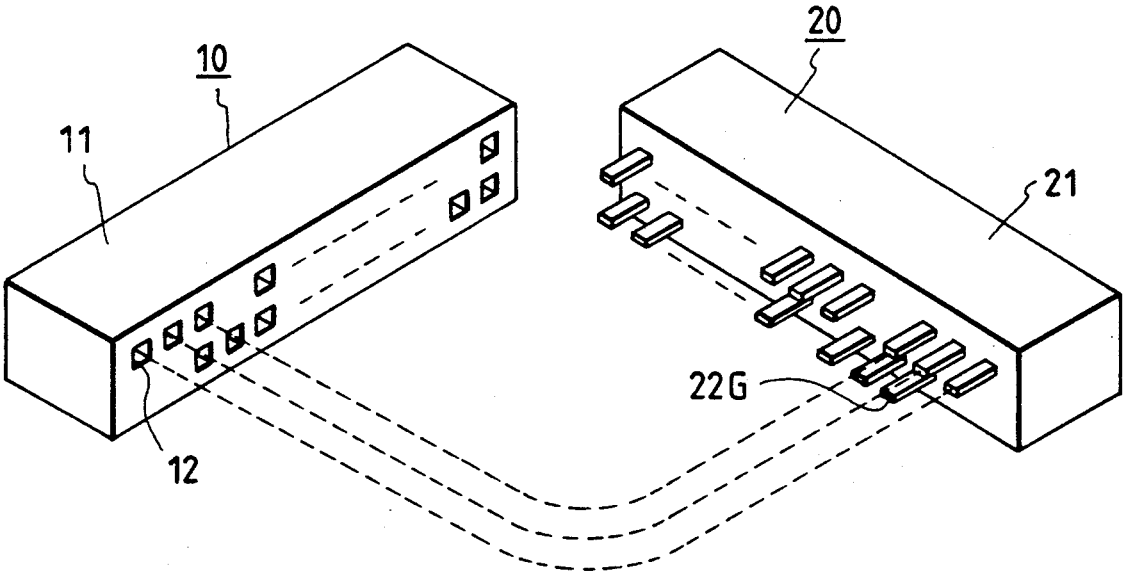
FIG. 3 is an exploded perspective view illustrating an embodiment of the present invention.

FIGS. 3 through 6 illustrate an embodiment of the present invention. In FIG. 3 reference numeral 10 denotes a connector socket, 11 a rectangular prismatic insulating body forming the connector socket 10, 12 female contact receiving holes, 20 a connector plug, 21 a rectangular prismatic insulating body, and 22G and 22S male pin contacts.

Figure 4:
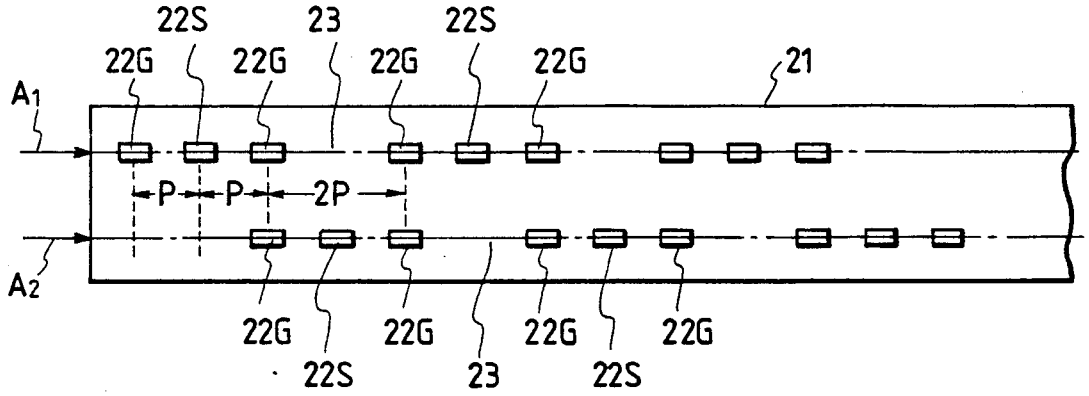
FIG. 4 is a plan view showing the construction of a connector plug 30 in FIG. 3.

FIG. 4 shows the front of the connector plug 20. The male pin contacts 22G and 23S form two rows lengthwise of the body 21. The female contacts 13 of the connector socket 10 are arranged symmetrically with the male pin contacts 22. The present invention has its feature in that the two pin contacts 22G and the one pin contact 22S disposed in parallel in the same plane form a triad and their widths and spacing are suitably selected to constitute one signal transmission line having a desired characteristic impedance. The pin contacts 22G disposed at the both sides of the pin contact 22S serve as grounding lines and the pin contact 22S as a signal line. The three pin contacts 22G, 22S, 22G are arrayed in a line in the same plane with the same center-to-center distance (i.e. at the same pitch) P, and on the extension of this array, there are disposed pin contacts of other triads. A plurality of triads of pin contacts 22G, 22S, 22G are arrayed to form a first array A1, with adjacent triplets of pin contacts spaced apart a distance (corresponding to 2P) equal to a space 23 for at least one pin contact.

Figure 5:
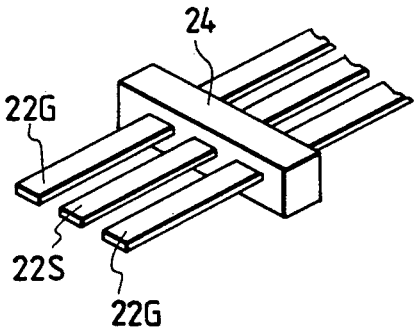
FIG. 5 is a perspective view for explaining a support structure for pin contacts which are mounted on the connector plug 30 shown in FIG. 4.
Figure 6:
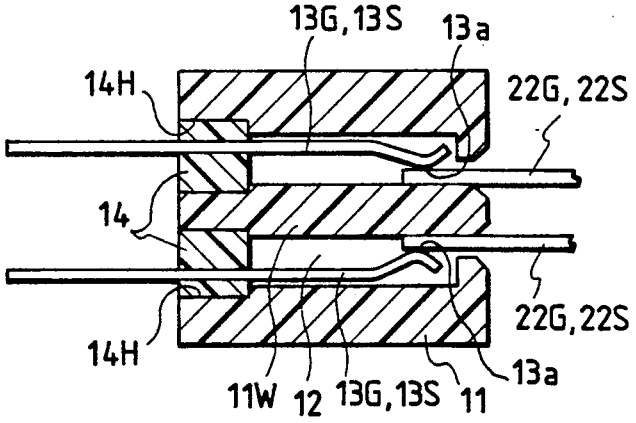
FIG. 6 is a sectional view of a connector socket in FIG. 4.

A second array A2 of pin contacts is disposed opposite the first array Al in the same plane. The pin contact 22S of each triad forming the second array A2 is disposed opposite the center of the space 23 defined between adjacent triads of contacts forming the first array A1. Thus, the contact 22S of each of the first and second arrays, serving as a signal line, is opposite the center of the space 23 of the other array. This suppresses the generation of crosstalk between adjacent signal transmission lines. The pin contacts which are fixedly mounted on the connector plug 20 are straight, stripe like members, which are supported, in triads, by a rectangular parallelepipedic insulating block 24 as shown in FIG. 5. The insulating block 24 can be built in the insulating body 21 forming the connector plug 20. With such a structure, when one of the contacts is broken, the part to be exchanged can be suppressed to a minimum.

The connector socket 10 has two arrays of contact receiving holes 12 made therein with the same center-to-center spacing, corresponding to the pin contacts 22G and 22S of the connector plug 20. In the contact, receiving holes 12 are female contacts 13G, 13S, 13G corresponding to the male pin contacts 22G, 22S, 22G of each triad. The female contacts 13G and 13S are each formed by a one-piece band-shaped spring contact. As is the case with the male pin contacts 22G and 22S shown in FIG. 5, the female contacts 13G, 13S, 13G of each triad are held by a rectangular parallelepipedic insulating block 14 in parallel and at the same pitch as that of the male pin contacts 22G, 22S and 22G, the insulating block 14 being pressed into a square hole 14H in the back of the insulating body 11 and communicating with the contact receiving holes 12. The female contacts 13G and 13S have their tip end portions curved convexly toward a central partition wall 11W of the insulating body 11 to form contact portions 13a for contact with the mating male pin contacts 22G and 22S. Each female contact 13G or 13S receives at its curved tip end portion the mating male pin contact 22G or 22S inserted into the contact receiving hole 12 and is thereby pushed aside, thus elastically holding the male contact 22G or 22S between the curved tip end portion and the center partition wall 11W of the insulating body 11. With such one-piece female contacts 13G and 13S of the connector socket 10 which make contact with the male pin contacts 22G and 22S at one point, a stable signal transfer characteristic is obtained.

Figure 7:
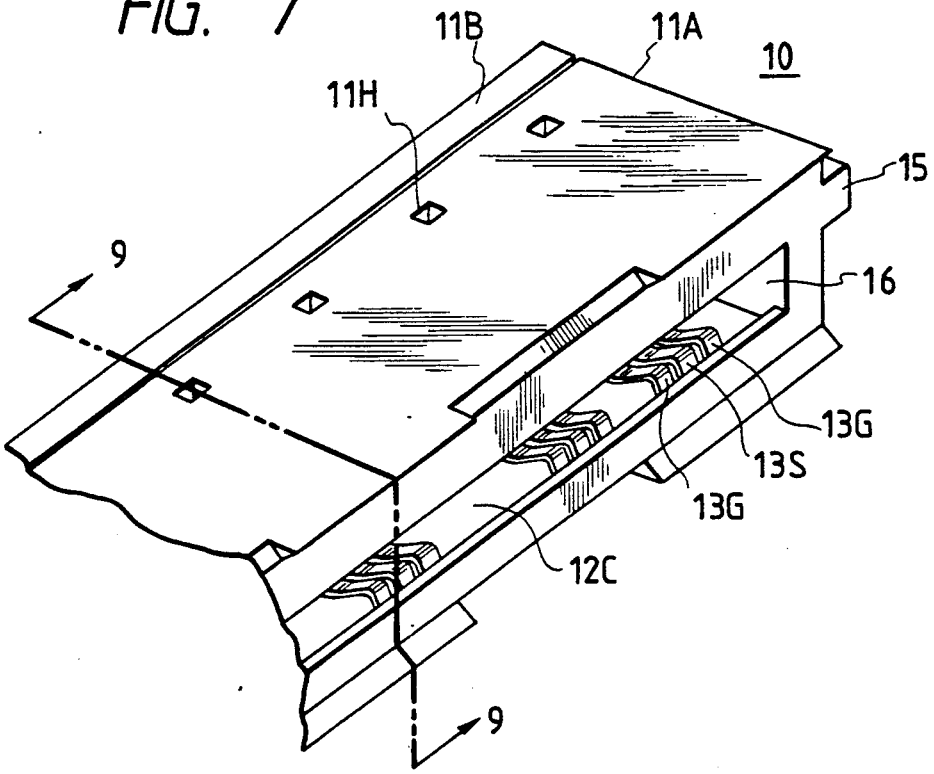
FIG. 7 is a perspective view of a connector socket in another embodiment of the present invention.
Figure 8:
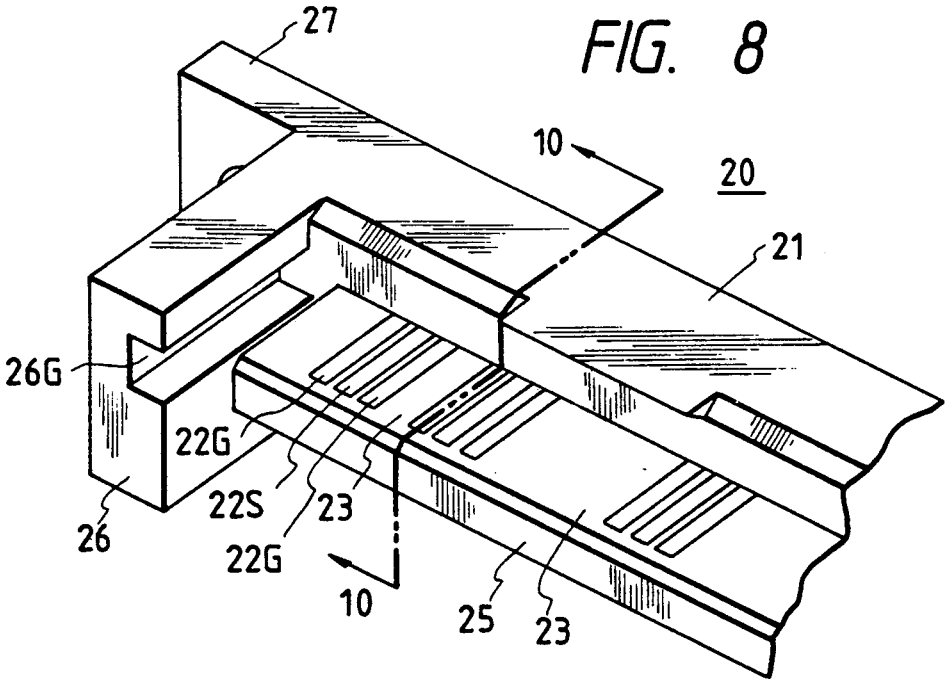
FIG. 8 is a perspective view showing the mating plug for the connector socket depicted in FIG. 7.
Figure 9:
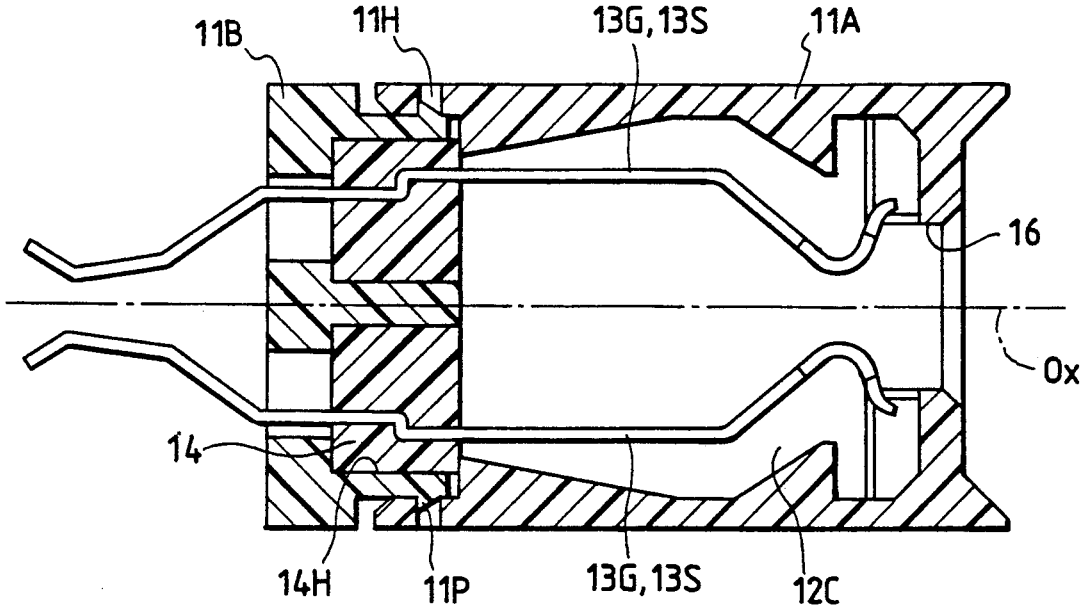
FIG. 9 is a sectional view taken on the line 9—9 in FIG. 7.
Figure 10:
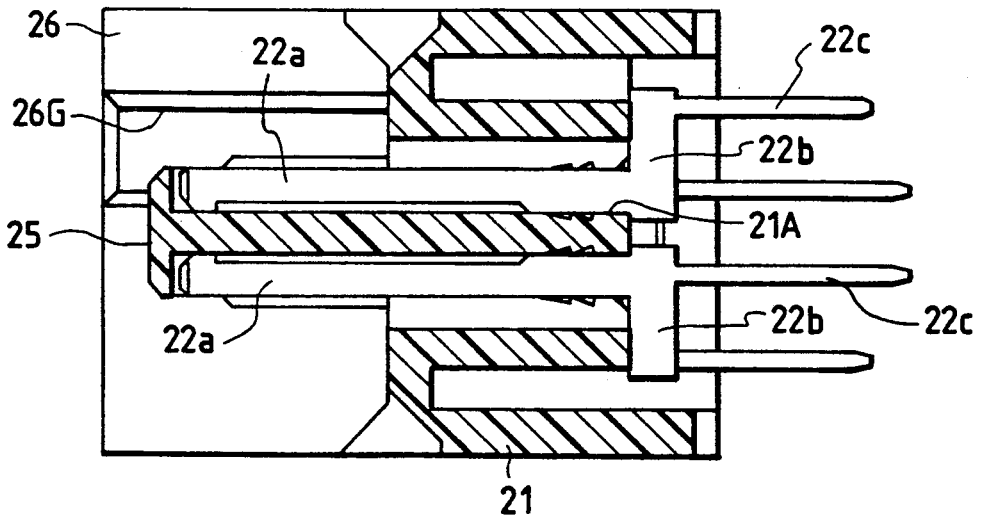
FIG. 10 is a sectional view taken on the line 10—10 in FIG. 8.

FIGS. 7 and 8 schematically illustrate the connector socket 10 and the connector plug 20 of the high-frequency multi-pin connector produced in accordance with another embodiment of the present invention. The connector socket 10 and the connector plug 20 are both symmetrical, and hence are shown only by half. FIGS. 9 and 10 are sectional views taken on the lines 9—9 and 10—10 in FIGS. 7 and 8, respectively. In this embodiment the connector socket 10 is composed of a contact housing 11A and a base body 11B. The contact housing 11A has in its front a slot 16, in which a contact receiving chamber 12C is formed. The contact receiving chamber 12C is open in the back of the contact housing 11A. The contact housing 11A has holes 11H made through its top and bottom panels along the rear marginal edges thereof for engagement with projections 11P extending from top and bottom outer wall surfaces of the base body 11B. In the base body 11B there are formed lengthwise thereof two rows of square holes 14H extending rearwardly from its front, and a square prismatic insulating block 14 carrying the three band-shaped spring female contacts 13G, 13S, 13G inserted therethrough is pressed into each square hole 14H. The triads of female contacts 13G, 13S, 13G arranged in two rows have their tip end portions bent toward the plane of the center axis Ox (FIG. 9) of the connector to form contact portions 13a. On both outer side walls there are protrusively provided guide ridges 15 extending in the front-to-back direction for guiding the connector plug 20.

The connector plug 20 comprises, as shown in FIG. 8, a rectangular prismatic base portion 21, a support panel portion 25 extending forwardly from the base portion 21 at a height substantially half that of the latter, side panel portions 26 extending forwardly from the base portion 21 in adjacent but spaced relation to both side ends of the support panel portion 25, and flange portions 27 extending from both ends of the base portion 21 lengthwise thereof. Such a connector plug 20 is produced as a unitary structure by molding of an insulating material In this embodiment the connector plug 20 has guide grooves 21A for the insertion thereinto of the male contacts 22, which grooves are cut and extend in the base portion 21 and the support panel portion 25 from the rear end of the former toward the front edge of the latter and are open along the top and bottom of the latter. The male pin contacts 22G and 22S are individually inserted into the connector plug 20 through the guide grooves 21A from the back of the base portion 21. One marginal portion of each of the pin contacts 22G and 22S is exposed from the guide groove 21A in the support panel 25.

The male pin contacts 22G and 22S are formed in two patterns, by punching out a sheet of metal. As depicted in FIG. 10, the two patterns each include a straight contact portion 22a, a fixed plate portion 22b extending from the rear end of the contact portion 22a at right angles thereto, and a terminal portion 22c extending from the plate portion 22b in alignment with the contact portion 22a or in staggered parallel thereto. The three male contacts 22 of each triad are of the same pattern but the male contacts of adjacent triads are of different patterns. In the inner side wall surface of each side panel 26 opposite one end of the support panel portion 25 there is cut a guide groove 26G for engagement with the guide ridge 15 of the connector socket 10 to ensure guiding the support panel portion 25 of the connector plug 20 into the slot 16 of the connector socket 10 while holding it at a correct position in a correct direction. As the support panel portion 25 is inserted into the slot 16, the female contacts 13G and 13S of the connector socket 10 are pushed outwardly of the plane of the center axis Ox and their contact portions 13a move onto the support panel portion 25 of the connector plug 20 and into resilient contact with the corresponding male pin contacts 22G and 22S.

Also in the embodiment shown in FIGS. 7 through 10, the three pin contacts 22G, 22S, 22G of each triad of the connector plug 20 are arranged at a predetermined pitch to form one signal transmission line and such signal transmission lines formed in the same plane (hereinafter referred to as a first plane) are spaced at least two pitches apart. In a second plane apart from and parallel to the first plane, triads of pin contacts 22G, 22S, 22G are similarly arranged. In this instance, the triads of pin contacts are arranged so that the signal pin contacts 22S of any triads in either one of the first and second planes do not stand opposite any pin contacts arranged in the other plane. In contrast thereto, the grounding pin contacts 22G arrayed in one plane may or may not be disposed opposite the grounding contacts 22G in the other plane. The same is true of the connector socket 10. The male pin contacts 22G, 22S, 22G of each triad, forming one signal transmission line in the connector plug 20, contact at one point the three female contacts 13G, 13S, 13G of the corresponding triad of the connector socket 10 which also constitute a signal transmission line.

As described above, according to the present invention, one signal transmission line is formed by three contacts arranged in the same plane and the central one of them is used as a signal line and the side contacts as grounding lines, by which a kind of open microstrip line structure can be formed. Thus, the characteristic impedance of each signal transmission line can be matched to a desired value by suitably selecting the widths of the contacts and their spacing.

Since the connector of the present invention is constructed so that the male pin contacts of each triad of the connector plug contact at one point the female contacts of the corresponding triad of the connector socket as described above, the parasitic capacitance or inductance is so small that the characteristic impedance of the transmission line can be held at a desired value.

In addition, with the above-described construction in which the triads of contacts are arranged in a line at intervals of at least two pitches of the contacts to form a first array and the contacts serving as signal lines in a second array are disposed opposite the space between the triads of contacts forming the first array, no cross-talk will occur between the signal transmission lines which are formed by the triads of contacts. Thus, the present invention offers a high-frequency multi-pin connector suitable for use in transmitting high-frequency signals.

It will be apparent that many modifications and variations may be effected without departing from the scope of the novel concepts of the present invention.

What is claimed is:

1. A high-frequency multi-pin connector, comprising:

a connector socket including a socket body formed of an insulating material, and first and second groups of triads of female contacts arranged in parallel in first and second plane, respectively, in contact receiving chambers in said connector socket, each triad of female contacts composed of elastic band-shaped female contacts as center and side contacts arranged in parallel the respective one of the first and second planes, the center contact being a signal contact and both side contacts being grounding contacts, each said triad of female contacts constituting a signal transmission line having a characteristic impedance set to a predetermined value by selecting widths and pitch of said triad of female contacts, said plurality of triads of female contacts in each of said first and second planes being spaced apart by a distance twice the pitch of said female contacts within each triad, and the signal contact in each triad in said second plane disposed opposite a space between a respective pair of said triads of female contacts in said first plane; and a connector plug including a plug body formed of an insulating material, and first and second groups of triads of male pin contacts arranged in parallel in third and fourth planes, respectively, mounted on said connector plug, each triad of male pin contacts mounted on said plug body and composed of three long and narrow male pin contacts as center and side contacts arranged in parallel in the respective one of the third and fourth planes, the center contact being a signal contact and the side contacts being grounding contacts, each said triad of male pin contacts constituting a signal transmission line with a characteristic impedance set to the predetermined value by selecting widths and pitch of said triad of male pin contacts, said triads of male pin contacts arranged in correspondence to said triads of female contacts and the signal contact in each triad in said fourth plane is disposed opposite a space between a respective pair of said triads of male pin contacts in said third plane, each corresponding pair of male and female contacts having a single area of contact when said connector plug is inserted into said connector socket.

2. The high-frequency multi-pin connector of claim 1, wherein said socket body is a rectangular prismatic member having holes extending backwardly from a front surface thereof to define the contact receiving chambers for each of said female contacts arranged in the first and second plane, and wherein said plug body is a rectangular prismatic member holding said male pin contacts projecting from a front surface thereof.

3. The high-frequency multi-pin connector of claim 1, wherein said male pin contacts of each triad are located in a square prismatic insulating block mounted on said plug body.

4. The high-frequency multi-pin connector of claim 1, wherein said female contacts of each triad are located in a square prismatic insulating block mounted on said socket body.

5. The high-frequency multi-pin connector of claim 1, wherein said socket body is a rectangular prismatic member with a slot extending rearwardly from said contact receiving chambers, wherein said triads of female contacts in said first and second planes are arranged in said contact receiving chamber along an opposed inner wall surface thereof, wherein said plug body includes a rectangular prismatic base portion having a front surface and a support panel portion extending forwardly from the front surface of said rectangular prismatic base portion for insertion into the slot, and wherein said triads of male pin contacts in said third and fourth planes pass through said rectangular prismatic base portion and are exposed along both sides of said support panel portion.

6. The high-frequency multi-pin connector of claim 5, wherein said socket body includes a housing portion having a rear opening formed therein, said contact receiving chambers extending therethrough in a front-to-back direction and said socket body includes a rectangular prismatic base body fitted into the rear opening of said housing portion, and wherein said female contacts of each triad are located in a rectangular parallelepipedic insulating block fitted into one hole of two rows of square holes in a front surface of said rectangular prismatic base body.

7. The high-frequency multi-pin connector of claim 5, wherein said support panel portion has ends substantially perpendicular to the third and fourth planes, wherein said plug body has side panel portions extending forwardly from said rectangular prismatic base portion in adjacent but spaced relation to the ends of said support panel portion, each of said side panels having a guide groove along a surface facing said support panel portion and extending in a front-to-back direction, and wherein said socket body has outer surfaces with guide ridges for slidable engagement with the guide grooves of said plug body.

8. The high-frequency multi-pin connector of claim 2, wherein said male pin contacts of each triad are located in a square prismatic insulating block mounted on said plug body.

9. The high-frequency multi-pin connector of claim 2, wherein said female contacts of each triad are located in a square prismatic insulating block mounted on said socket body.

10. The high-frequency multi-pin connector of claim 6, wherein said support panel portion has ends substantially perpendicular to the third and fourth planes, wherein said plug body; has side panel portions extending forwardly from said rectangular prismatic base portion in adjacent but spaced relation to the ends of said support panel portion, each of said side panel portions having a guide groove along a surface thereof and extending in a front-to-back direction, and wherein said socket body has outer surfaces with guide ridges for slidable engagement with the guide grooves of said plug body.

11. A high-frequency multi-pin connector, comprising:

a connector body a first group of triads of contacts, each triad of contacts forming one signal transmission line, arranged in a first plane of said connector body, with a center contact of each triad being a signal contact and side contacts being grounding contacts, the contacts in each triad having a pitch therebetween and widths selected such that the signal transmission line formed by each triad has a predetermined characteristic impedance, said triads of contacts in the first plane being spaced apart by at least two pitches of said contacts to define a space between said triads; and a second group of triads of contacts, similar in construction to said first group of triads of contacts in the first plane, arranged in a second plane parallel to the first plane, with a signal contact of each triad in the first plane disposed opposite the space between a respective pair of said triads of contacts in the second plane.

* * * * *

UNITED STATES PATENT AND TRADEMARK OFFICE

CERTIFICATE OF CORRECTION

PATENT NO. : 5,145,387

DATED : September 8, 1992

INVENTOR(S) : Ichihashi

It is certified that error appears in the above-identified patent and that said Letters Patent is hereby corrected as shown below:

Col. 3, line 36, after "contact" delete ",";

Col. 5, line 60, "plane" should be --planes--;
line 65, after "parallel" insert --in--;

Col. 8, line 5, after "body" delete ";".

Signed and Sealed this

Fifth Day of October, 1993

Bruce Lehman

*Attest:*

BRUCE LEHMAN

*Attesting Officer*

*Commissioner of Patents and Trademarks*